United States Patent [19]

Paull et al.

[11] 3,976,442

[45] *Aug. 24, 1976

[54] SYNTHESIS GAS FROM GASEOUS $CO_2$-SOLID CARBONACEOUS FUEL FEEDS

[75] Inventors: Peter L. Paull, Weston, Conn.; Warren G. Schlinger, Pasadena, Calif.

[73] Assignee: Texaco Inc., New York, N.Y.

[ * ] Notice: The portion of the term of this patent subsequent to Aug. 24, 1993 has been disclaimed.

[22] Filed: Dec. 18, 1974

[21] Appl. No.: 533,908

[52] U.S. Cl. ..... 48/197 R; 48/203; 48/210; 252/373; 423/415 R

[51] Int. Cl.[2] ..... C10J 1/00

[58] Field of Search ..... 48/197 R, 210, 203, 48/209, 206; 252/373; 423/415

[56] References Cited

UNITED STATES PATENTS

| | | | |
|---|---|---|---|
| 3,723,344 | 3/1973 | Reynolds | 252/373 |
| 3,868,817 | 3/1975 | Marion et al. | 48/215 |

*Primary Examiner*—Robert L. Lindsay, Jr.
*Assistant Examiner*—George C. Yeung
*Attorney, Agent, or Firm*—T. H. Whaley; C. G. Ries; Albert Brent

[57] ABSTRACT

This is an improved continuous partial oxidation process for producing synthesis gas or fuel gas from gaseous $CO_2$-solid carbonaceous fuel feeds. A solid carbonaceous fuel such as finely ground coal from a pressurized lock hopper is passed directly into a high pressure high velocity $CO_2$-rich gas stream which carries the particles of coal into a free-flow noncatalytic gas generator where by the partial oxidation reaction with a free-oxygen containing gas, preferably in the absence of supplemental $H_2O$ other than that normally present in the reactants, gaseous mixtures principally comprising $H_2$, CO, $CO_2$, and $H_2O$ are produced. A $CO_2$-rich gas stream is recovered downstream in the process and recycled to the pressurized feed system. The $CO_2$-rich stream serves as a carrier for the carbonaceous fuel and as a reactant in the reaction zone.

12 Claims, 1 Drawing Figure

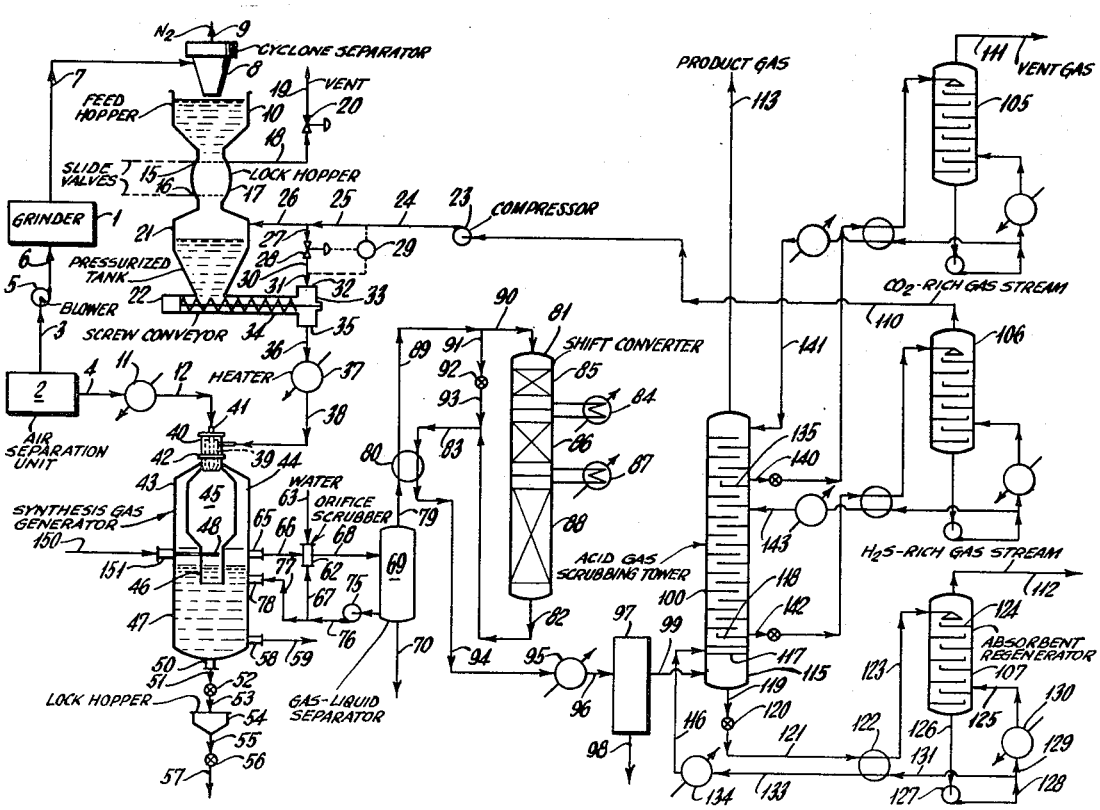

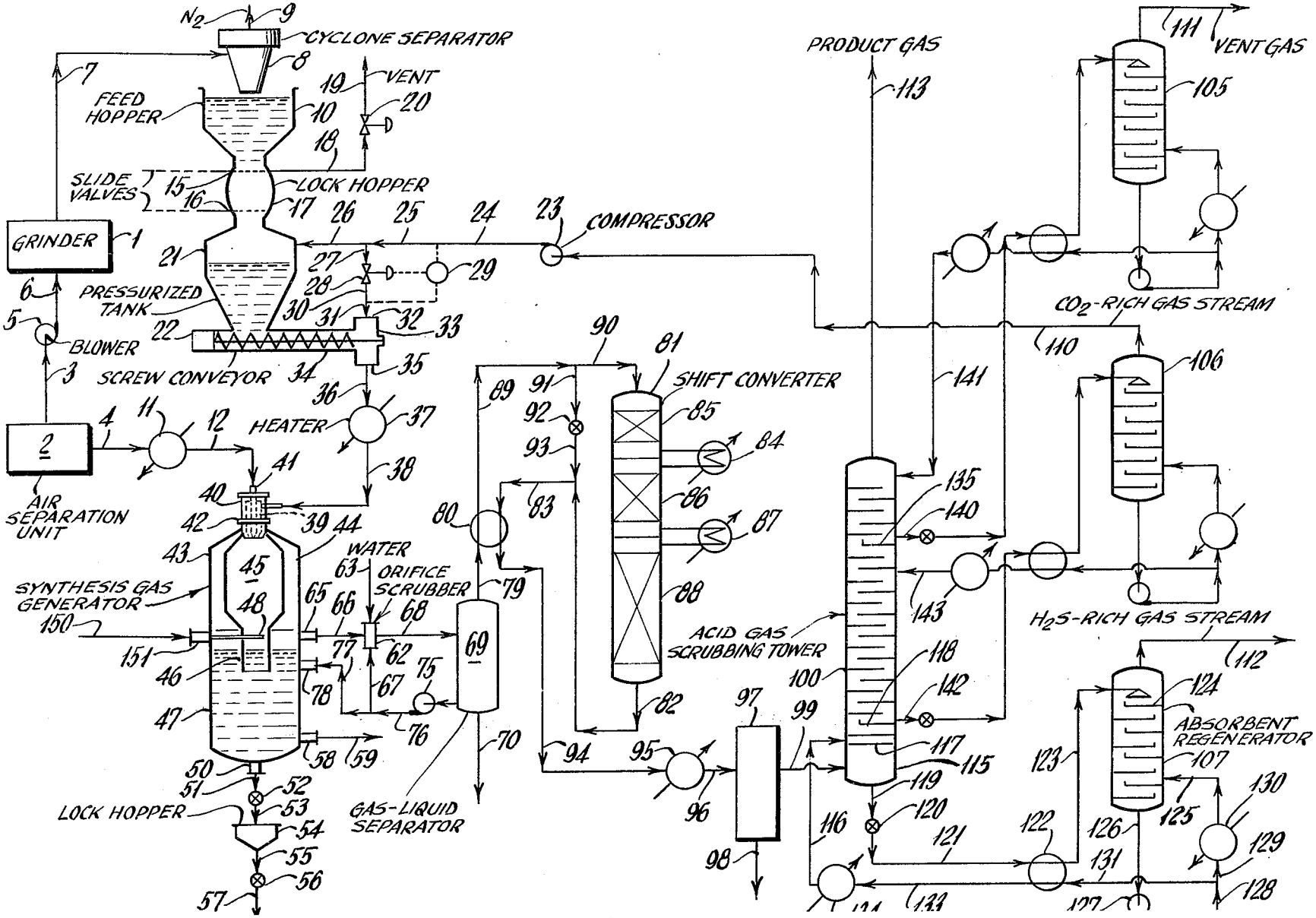
VENT GAS
$CO_2$-RICH GAS STREAM
$H_2S$-RICH GAS STREAM
ABSORBENT REGENERATOR
PRODUCT GAS
SHIFT CONVERTER
ACID GAS SCRUBBING TOWER
COMPRESSOR
CYCLONE SEPARATOR
VENT
LOCK HOPPER
FEED HOPPER
SLIDE VALVES
PRESSURIZED TANK
SCREW CONVEYOR
HEATER
WATER
ORIFICE SCRUBBER
GAS-LIQUID SEPARATOR
GRINDER
BLOWER
AIR SEPARATION UNIT
SYNTHESIS GAS GENERATOR
LOCK HOPPER
$N_2$

SYNTHESIS GAS FROM GASEOUS $CO_2$-SOLID CARBONACEOUS FUEL FEEDS

BACKGROUND OF THE INVENTION

1. Field of the Invention

This invention relates to a continuous process for the production of a CO-rich gas stream by the partial oxidation of a solid carbonaceous fuel. More specifically, the present invention relates to the production of synthesis gas by noncatalytic partial oxidation starting with gaseous $CO_2$-solid carbonaceous fuel e.g. ground coal, and a free-oxygen containing gas e.g. air, or substantially pure oxygen.

2. Description of the Prior Art

Oil embargoes coupled with already developing petroleum shortages have led to an energy crisis in this country. To help meet the accelerating demand for energy, exploration and development of conventional petroleum resources have been stepped up. However, long-term solutions demand that alternate energy resources be developed and utilized to the maximum degree. Coal is the most promising raw material in the USA for the production of synthetic natural gas (SNG) and synthesis gas i.e. mixtures of $CO+H_2$. In the U.S. in 1970 the estimated recoverable coal reserves assuming 50 percent recovery were about 778 billion short tons. In comparison in the U.S. in 1974 the proved reserves of crude oil amounted to about 35 billion barrels.

$H_2O$ is commonly used as a temperature moderator in the partial oxidation of hydrocarbonaceous fuels to produce synthesis gas. However, problems with water as a temperature moderator are encountered with solid carbonaceous fuels when water soluble solids separate and precipitate on heating surfaces in the system. Further, the high heat of vaporization of water reduces thermal efficiency. In coassigned U.S. Pat. No. 3.705,108 in addition to $H_2O$, inert gases such as nitrogen and $CO_2$ were suggested to control the combustion of oil.

A principal limitation to the use of large reserves of sulfur-containing coal possessed by the United States in particular as well as some other countries is concern for environmental pollution. The subject gasification process appears to be a most feasible way of utilizing sulfur-containing coal for a wide variety of purposes, including the production of synthesis gas, fuel gas and the generation of power, with minimal or negligible deleterious effect upon the environment. Further, when production of synthesis gas i.e. $H_2+CO$ and the processing of the synthesis gas by catalytic synthesis into oxygen containing hydrocarbons e.g. alcohols, aldehydes and into gasoline and diesel fuels, are both done at the mine, then cross-country rail transport of bulk coal may be eliminated at substantial savings. Advantageously, this may be done by the subject invention.

SUMMARY

This is a continuous process for producing a gas stream principally comprising gases selected from the group consisting of CO, $H_2$, $CO_2$, $H_2O$, $CH_4$, $H_2S$, COS, $N_2$, A, and mixtures thereof comprising:

1. dispersing ground solid particles of carbonaceous fuel in a high pressure high velocity stream of $CO_2$-rich gas having a pressure in the range of about 50 to 5000 psig and a velocity in the range of about 5 to 500 ft. per sec. and optionally preheating said dispersion to a temperature in the range of about 80° to 1200°F;
2. introducing the materials from (1) and a free-oxygen containing gas at a temperature in the range of about 80° to 500°F into the reaction zone of a free-flow noncatalytic gas generator; (3) reacting said carbonaceous fuel and a free-oxygen containing gas by partial oxidation and reacting $CO_2$ in said reaction zone at an autogenous temperature in the range of about 1200° to 3000°F and a pressure in the range of about 30 to 4800 psig, (4) separating a $CO_2$-rich gas stream from the effluent gas stream from (3) in an acid-gas recovery zone, and (5) compressing said $CO_2$-rich gas stream and recycling said stream to (1) as said high pressure high velocity stream of $CO_2$-rich gas.

DESCRIPTION OF THE INVENTION

The present invention pertains to an improved continuous partial oxidation process for producing gas mixtures containing for example $H_2$ and CO starting with gaseous $CO_2$-solid carbonaceous fuel feeds.

Some of the advantages to be gained by using a $CO_2$-rich gas stream as a solid carbonaceous fuel transport medium and reactant in the production of synthesis gas by partial oxidation include: (1) to provide an additional source of product gas, and the reduction of single pass carbon through the reaction $C+CO_2 \rightarrow 2\,CO$; (2) reliable steady and controllable feeding of comparatively low cost high sulfur containing solid fuel feed materials; (3) reduced requirements and higher product gas make per unit of feed; (4) elimination of heat exchange fouling which results from vaporizing a coal-water slurry external to the burner; (5) avoiding excessive duty and temperature degradation of recoverable heat when using a waste heat boiler to recover heat from the syntheseis gas; also to lower the dew point of the synthesis gas to allow greater efficiency of heat recovery; (6) production of sulfur-free synthesis gas having a high CO content; and (7) simplifying the production of a feed stream for a Claus unit to produce sulfur.

The solid carbonaceous fuels are preferably ground to a particle size so that 100% of the material passes through an ASTM E 11-70 Sieve Designation Standard 425 $\mu$m (Alternative No. 40) and at least 80% passes through an ASTM E 11-70 Sieve Designation Standard 75 $\mu$m (Alternative No. 200). 1000 $\mu$m = 1mm. The ground solid carbonaceous fuel is then introduced into a storage hopper at room temperature and atmospheric pressure.

The term solid carbonaceous fuel, as used herein to described suitable solid carbonaceous and hydrocarbonaceous feedstocks for the subject process, is intended to include various materials and mixtures thereof from the group consisting of coal, coke from coal, char from coal, petroleum coke, particulate carbon soot, oil shale, tar sands, and pitch. All types of coal may be used including anthracite, bituminous and lignite. The particulate carbon may be that which is obtained as a by-product of the subject partial oxidation process (to be further described), or that which is obtained by burning fossil fuels. Also, the term solid carbonaceous feedstock includes by definition hydrocarbonaceous and carbonaceous materials such as asphalt, rubber, rubber automobile tires either alone or in admixture with each other or with said aforesaid group of materials which have been ground or pulverized to the aforesaid sieve analysis. Any suitable conventional grinding system may be used to convert the solid carbonaceous fuels or mixtures thereof to the proper size.

The moisture content of the solid carbonaceous fuel particles is in the range of about 0 to 10 weight percent (wt. %) and preferably 0 to 2 wt. %, say 0 to 1 wt. % Predrying may be required in some instances to reach these levels.

The pressurized feed system used herein to disperse the finely ground solid carbonaceous fuel in the high pressure high velocity stream of $CO_2$-rich gas having a pressure in the range of about 50 to 5000 psig and a velocity in the range of about 5 to 500 ft. per sec. includes a pneumatic transport system, gas-solids separator, a feed hopper, lock hopper, pressurized running tank, and positive feed metering means.

In operation, a pneumatic transport system using nitrogen or $CO_2$-rich gas, which offer no explosion or fire hazard, as the carrier stream may be used to lift the solid carbonaceous fuel from the mills and to transport it to a gas-solids separator. Nitrogen gas is readily available as a by-product from the air separation unit which produces substantially pure oxygen for reaction in the gas generator. $CO_2$-rich gas may be obtained from the acid-gas separation unit downstream in the process and comprises in mole % $CO_2$ 80 to 100 and $H_2S$ 0 to 20. Optionally, the carrier gas may be preheated to a temperature in the range of about 80°F to 300°F in order to assist in drying the ground solid carbonaceous fuel during transport. A cyclone or series of cyclones may be used to disengage the carrier gas from the particles of solid fuel. The solid fuel particles then drop out of the bottom of the cyclone separator and into a feed hopper at room temperature and atmospheric pressure.

The particles of solid fuel drop by gravity first into a lock hopper and then into a pressurized running tank. The lock hopper is vented between cycles. Compressed $CO_2$-rich gas at a pressure in the range of about 50 to 5000 psig and a temperature in the range of about 80 to 300°F is introduced into the top of the pressurized running tank. Vented $CO_2$-rich gas from the lock hopper may be returned to the $CO_2$ compressor suction.

The ground solid fuel drops from the bottom of the running tank into a controllable rate positive feed device which is used to meter the particles of solid fuel into a mixer. For example, a variable speed conveying screw or a star wheel may be used for metering the pulverized feed into one passage of a jet mixer while a stream of compressed $CO_2$-rich gas recovered downstream in the process is passed through the other passage of the jet mixer. A venturi or nozzle in the jet mixer provides a controlled but slight pressure drop across the mixer. Alternately, the pressure drop may be accomplished by means of a differential pressure controller on a throttling valve placed in the $CO_2$-rich gas stream line just upstream of a free-flow "T" mixer. The term "T" mixer as used herein is meant to mean the interconnection of a first conduit between the inlet end and discharge end of a straight conduit so that the angle of incidence is in the range of about 15° to 90°.

A thoroughly mixed dispersion of ground solid carbonaceous fuel and $CO_2$-rich gas having a solids content in weight percent of 25 to 70 leave the discharge end of the mixer and are optionally but preferably passed through a heater or heat exchanger. For example, a tubular heater of relatively greater length in comparison with its cross sectional area may be used. The volume and velocity of the dispersion flowing within the tubular heater are such as to ensure highly turbulent flow conditions, which when combined with the heat and pressure therein promotes the further attrition and disintegration of the solid carbonaceous fuel and the further dispersal of fine carbonaceous solid particles in a fluidized dispersion of $CO_2$-rich gas. The dispersion of ground solid fuel and $CO_2$-rich gas at a temperature in the range of about ambient to 600°F. and advantageously after preheating to a temperature in the range of about 80° to 1200°F. is then introduced into a free-flow partial oxidation non-catalytic synthesis gas generator at a pressure in the range of about 30 to 5000 psig, preferably about 200 to 1500 psig, and a velocity in ft. per sec. in the range of about 5 to 500, preferably about 100 to 300.

The dispersion of $CO_2$-rich gas and solid carbonaceous fuel feed stream is thoroughly mixed with and reacted with a stream of free-oxygen in the reaction zone of a free-flow unpacked synthesis gas generator. Preferably, no supplemental $H_2O$ from an external source is introduced into the reaction zone, other than the relatively minor amount of $H_2O$ that may be present in the reactants.

The $CO_2$-rich gas-solid carbonaceous fuel feed stream may be supplied to the reaction zone of the gas generator preferably by way of the annulus passage of a suitable annulus-type burner. Simultaneously, a stream of free-oxygen containing gas is supplied to the reaction zone of the gas generator preferably by way of the central passage in the burner at a temperature in the range of about 80° to 500°F and preferably in the range of about 200° to 300°F and a pressure in the range of about 50 to 5000 psig, and preferably in the range of about 200 to 1500 psig.

The term free-oxygen containing gas, as used herein is intended to include air, oxygen-enriched air, i.e. at least 22 mole % oxygen, and substantially pure oxygen i.e. at least 95 mole % oxygen (the remainder comprising $N_2$ and rare gases).

In one embodiment of the process as shown in the drawing for this specification, the discharge end of the annulus type burner assembly is inserted into the reaction zone of a compact unpacked free-flow noncatalytic refractory-lined synthesis gas generator. The discharge end of the annulus burner comprises an axially disposed center conduit through which a stream of free-oxygen containing gas may be passed, surrounded by an annular passage through which the stream of $CO_2$-rich gas-solid fuel mixture or dispersion may be passed. Near the tip of the burner the annular passage converges inwardly in the shape of a hollow right cone. The $CO_2$-solid fuel feed stream may be thereby accelerated and discharged from the burner as a high velocity conical stream. When for example a high velocity stream of oxidizing gas hits a relatively low velocity stream of the feed dispersion, the particles of solid carbonaceous fuel impinge against one another and may be fragmented still further. The discharge velocity of the $CO_2$-rich gas-solid fuel feed dispersion from the burner may be in the range of about 5 to 500 feet per second (ft. per sec.) and suitably in the range of about 5 to 50 ft. per sec. and advantageously 100 to 300 ft. per sec. at the burner tip.

The discharge velocity of the free-oxygen containing gas is in the range of about 110 ft. per sec. to sonic velocity at the burner tip, and preferably in the range of about 200 to 600 ft. per sec. Most suitably, the relative velocity difference between the aforesaid two streams being simultaneously discharged from the burner should be at least 100 ft. per sec. Further, the feed to the burner may be reversed. In such instance, said $CO_2$-rich gas-solid carbonaceous fuel feed dispersion is passed through the center passage while the free-oxygen containing gas is passed through the annular passage of the burner.

The relative proportions of solid carbonaceous fuel, $CO_2$, and free oxygen in the reaction zone of the gas generator are such as to ensure an autogenous temperature in the gas generation zone within the range of about 1200° to 3000°F, such as about 1700° to 3000°F, and to produce a particulate phase containing ash and about 0.1 to 20 weight percent (wt. %) of the organic carbon in the feed, and preferably about 1 to 4 wt. %. The particulate phase is entrained in the effluent gas stream leaving the reaction zone along with any noncombustible slag.

Other operating conditions in the gas generator include: pressure in the range of about 30 to 4800 psig and preferably 450 to 1500 psig; the ratio of the atoms of free-oxygen containing gas plus the atoms of organically combined oxygen in the solid carbonaceous fuel per atom of carbon in the solid carbonaceous fuel (O/C atomic ratio) may be in the overall range of about 0.7 to 1.6. More specifically, with substantially pure oxygen feed to the reaction zone the broad range of said O/C atomic ratio may be about 0.7 to 1.5 and preferably with air feed to the reaction zone the broad range may be about 0.8 to 1.6 and preferably about 0.9 to 1.4; weight ratio of $CO_2$ to carbon in the solid carbonaceous fuel feed in the range of about 0.5 to 2.0, and preferably in the range of about 0.7 to 1.0; and a time in the reaction zone in the range of about 1 to 10 seconds, and preferably in the range of about 2 to 8. Preferably, the partial oxidation of the solid carbonaceous fuel takes place in the reaction zone in the absence of a separate stream of supplemental $H_2O$, but not excluding the relatively small amount of $H_2O$ that may be present in the other reactant streams. In one embodiment $H_2O$ at a temperature in the range of about 50° to 1000°F and in an amount to provide a weight ratio $H_2O$ to solid carbonaceous fuel in the range of about 0.01 to 0.15 is introduced into the reaction zone. This amount is well below the minimum weight ratio of $H_2O$/fuel commonly used with a solid or liquid fuel in a synthesis gas generator and may be introduced separately or in admixture with either of the two reactant streams. With substantially pure oxygen feed to the gas generator, the composition of the effluent gas from the gas generator in mole % dry basis may be as follows: $H_2$ 5 to 25, CO 40 to 75, $CO_2$ 5 to 25, $CH_4$ 0.01 to 3, and $H_2S$+COS 0 to 5, $N_2$ nil to 5, and A nil to 1.5. With air feed to the gas generator, the composition of the generator effluent gas in mole % dry basis may be as follows: $H_2$ 2 to 20, CO 15 to 35, $CO_2$ 5 to 25, $CH_4$ 0 to 2; $H_2$ S+COS 0 to 3, $N_2$ 45 to 70, and A 0.1 to 1.5.

The hot gaseous effluent stream from the reaction zone of the synthesis gas generator is quickly cooled below the reaction temperature to a temperature in the range of 300°–700°F. In one embodiment of our invention, the hot gaseous effluent stream is cooled below the reaction temperature by direct quenching with a water spray. For example, the cooling water may contact the effluent gas stream in a quench vessel or chamber located below the reaction zone of said gas generator. An interconnecting passage between the reaction zone and the quench zone through which the hot effluent gases may pass substantially equalizes the pressure in the two zones. Recycle water from the carbon recovery zone or clean carbon-water dispersion to be further described may be introduced through a spray ring at the top of the quench zone. Large quantities of steam are generated in the quench vessel and saturate the process gas stream. This may provide the additional steam required for subsequent water-gas shift reaction.

Substantially all of the solids are scrubbed from the effluent gas. A dispersion of unconverted particulate carbon, ash, and quench water is thereby produced. Any residual solids in the cooled and scrubbed effluent synthesis gas leaving the quench chamber may be removed by means of a conventional venturi or jet scrubber, such as described in Perry's Chemical Engineers' Handbook, Fourth Edition, McGraw Hill Co., 1968, pages 18–55 to 56.

Noncombustible solid particles such as ash, slag, silt, metal constituents, metal silicates and other solids which do not disperse in the quench water drop to the bottom of the quench vessel where they are periodically removed through a lock hopper system. This residue has some commercial value and may be used as a soil improver, or it may be sent to a metals reclaiming unit. For example, coal ash may be removed from the flanged exit port at the bottom of the quench tank by way of the lock hooper system shown in the drawing. For each 100 pounds of raw ground coal fed to the gas generator about 0 to 50 pounds of ash are produced. On a dry basis the ash residue may comprise in wt. %; $SiO_2$ 10 to 50, $Al_2O_3$ 10 to 50, iron oxides and sulfides 0 to 40, and others.

Alternately, the hot effluent gas stream from the reaction zone of synthesis gas generator may be partially cooled to a temperature in the range of about 300° to 650°F. by indirect heat exchange in a waste heat boiler. Most of the ash drops out of the effluent stream before entering the waste heat boiler, and after quenching is removed by a lock hopper. The remaining entrained solid particles may be then scrubbed from the effluent synthesis gas by contacting and further cooling the effluent stream of synthesis gas with quench water in a gas-liquid contact apparatus, for example, a spray tower, venturi or jet scrubber, bubble plate contactor, packed column or in a combination of said equipment. For a detailed description of cooling synthesis gas by means of a waste-heat boiler and a scrubbing tower, reference is made to coassigned U.S. Pat. No. 2,999,741, issued to R. M. Dille et al. When substantially pure oxygen is fed to the gas generator, the synthesis gas leaving the cooling and scrubbing zone may be purified and used as a source of feed gas for the synthesis of hydrocarbons or oxygen-containing organic compounds.

It is important with respect to the economics of the process that the solid particles e.g. particulate carbon and ash be removed from the cooling and scrubbing water to permit the resulting clear water to be recycled and reused for cooling and scrubbing additional synthesis gas. This may take place in a liquid-solids separating zone.

In the liquid-solids separating zone any suitable method may be used for producing separate streams of clear water, ash, and particulate carbon. For example, a particulate carbon-ash-water dispersion may be introduced a suitable standard gravity sedimentation unit or settler. Clear water is drawn off and recycled to the synthesis gas cooling and scrubbing zone. Froth flotation may be used to produce separate streams of ash and thickened slurry of carbon and water. The carbon-water slurry may be dried to produce relatively low ash dry solid particulate carbon which may be ground and recycled to the feed hopper as a portion of the solid carbonaceous fuel.

Since $CO_2$ is consumed in the reaction zone, supplemental $CO_2$ from an outside source may be supplied to the system. Preferably, however, the supplemental $CO_2$ may be produced in the system while simultaneously increasing the hydrogen content by catalytic water-gas shift. For example, all of a portion of the scrubbed synthesis gas with or without the addition of supplemental $H_2O$ may be reacted at a temperature in the range of about 600° to 1000°F over a conventional water-gas shift catalyst e.g. 85 wt. % of $Fe_2O_3$ and 15 wt. % of $Cr_2O_3$ to convert the CO into $H_2$ and $CO_2$. Alternatively, cobalt molybdate shift catalyst may be used. The shifted and unshifted portions of the process gas stream may be then combined.

The process gas stream is then cooled to condense out and separate $H_2O$. Carbon dioxide and other acid gas constituents are removed next by conventional procedures including refrigeration and chemical absorption with either methanol, hot potassium carbonate, alkanolamine solutions, or some other absorption material. By this means, the dry process gas stream may be split into the following gaseous streams:

a. a dry $CO_2$-rich gas stream substantially comprising $CO_2$ and minor amounts of $H_2S$ and COS impurities. The composition of this stream in mole % may be about $CO_2$ 90 to 100, $H_2S$ 0 to 10, and COS 0 to 1;

b. optionally, a relatively small vent gas stream comprising substantially pure $CO_2$. The vent gas may contain less than 1–5 parts per million (ppm) of $H_2S$ and may be safely discharged to the atmosphere without causing pollution. In another embodiment this stream may be eliminated;

c. a dry $H_2S$-rich gaseous stream comprising gases from the group $H_2S$, COS, $CO_2$, and mixtures thereof. This gas stream may comprise the remainder of all of the $H_2S$ produced, substantially all of the COS produced, and the balance $CO_2$. The composition of this stream in mole % may be about $H_2S$ 20 to 50, COS 0 to 2, and the balance $CO_2$.

d. a dry product gas stream substantially comprising CO and $H_2$. When the free-oxygen containing gas is substantially pure oxygen, the composition of this stream in mole % dry basis may be about CO 50 to 70, $H_2$ 30 to 50, $N_2$ nil to 5, and A nil to 1.5, and after water-gas shift and $CO_2$ removal the composition in mole % may be about CO 0.5 to 10, $H_2$ 90 to 98, $N_2$ nil to 5, and A nil to 1.5. When the free oxygen containing gas is air, the composition of this stream in mole % dry basis may be about CO 15 to 40 and $H_2$ 10 to 35, $N_2$ 40 to 70, and A 0.5 to 1.5; and with water-gas shift and $CO_2$ removal the composition in mole % may be about CO 0.5 to 2, $H_2$ 35 to 60, $N_2$ 40 to 60, and A 0 to 1.0.

The dry $CO_2$-rich gas stream (stream *a*), optionally in admixture with vent gas (stream *b*), is then compressed to a pressure in the range of about 50 to 5000 psig and recycled to pressurized feed system as previously discussed.

The dry $H_2S$-rich gaseous stream (*d*) may be sent to a conventional Claus unit where it is burned with air to produce solid sulfur by-product and water. Excess nitrogen and other non-polluting gaseous impurities may be vented to the atmosphere.

When substantially pure oxygen is fed to the gas generator, the dry product gas (stream *d*) may be used as feedstock in catalytic process for chemical synthesis e.g. to synthesize alcohols, aldehydes, hydrocarbons etc.

This stream may have a heat content up to about 350 British Thermal Units per Standard Cubic Feet (BTU per SCF) and may be used as a fuel gas. Alternately, the heating value may be increased to a value in the range of about 400 to 1000 BTU per SCF by the steps of (1) optionally, adjusting the mole ratio $H_2$/CO to a value in the range of about 1 to 5; (2) reacting the CO and $H_2$ in the process gas stream at a temperature in the range of about 600 to 900°F and at substantially generator pressure in a catalytic methanation zone employing conventional methanation catalysts; and (3) separating out the $H_2O$, $CO_2$ and other impurities to produce a $CH_4$-rich gas stream comprising in mole % $CH_4$ 90 to 95; CO 0 to 5; and $H_2$ 0 to 5.

Ranges have been designated herein in the conventional manner. For example, a mole ratio of $H_2$/CO in the range of about 1 to 5 means 1 to 5 moles of $H_2$ per mole of CO.

DESCRIPTION OF THE DRAWING

A more complete understanding of the invention may be had by reference to the accompanying schematic drawing which shows the previously described process in detail. Although the drawing illustrates a preferred embodiment of the process of this invention, it is not intended to limit the continuous process illustrated to the particular apparatus or materials described.

With reference to the drawing, solid carbonaceous fuel is ground to a particle size so that 100% of the material passes through an ASTM E 11-70 Sieve Designation Standard 425 82 m (Alternative No. 40) and at least 80% passes through an ASTM E 11-70 Sieve Designation Standard 75 μm (Alternative No. 200) in a grinder or pulverizer 1. In a conventional air separation unit 2, air is split into a nitrogen stream which leaves by line 3 and substantially pure oxygen (95 mole % $O_2$ or more) which leaves by way of line 4. By means of blower 5, nitrogen preferably at a temperature of about 100°F higher than ambient is passed through line 6, to lift the particles of solid fuel from the mills and to transport them through line 7 to centrifugal cyclone separator 8 or to a series of cyclones. Nitrogen and water vapor are disengaged from the gas-solid dispersion and may be vented to the atmosphere via line 9 at the top of the cyclone separator. Simultaneously, the dry ground solid carbonaceous fuel particles drop from the bottom of the cyclone into feed hopper 10.

Slide valves 15 and 16 control the flow of the solid fuel from the bottom of feed hopper 10 into lock hopper 17. During the filling and emptying of lock hopper 17 by operating valves 15 and 16, lines 18–19 and valve 20 serve to cyclically vent $CO_2$-rich gas from lock hopper 17 in conjunction with the operation of valves 15 and 16.

Pressurized running tank 21 keeps screw conveyor 22 continuously supplied with ground solid carbonaceous fuel. Compressor 23 passes compressed $CO_2$-rich gas through lines 24–26 into pressurized tank 21. A second portion of said $CO_2$-rich gas is passed through line 27, throttling valve 28 controlled by differential pressure control 29, and lines 30–31 into the straight angle passage 32 of "T" mixer 33. Simultaneously, ground solid carbonaceous fuel is fed into the normal passage 34 of "T" mixer 33 by means of screw conveyor 22. Optionally, the feed streams may be respectively interchanged so that the ground solid fuel is discharged through the vertical passage.

A thoroughly mixed dispersion of ground solid carbonaceous fuel in $CO_2$-rich gas is discharged at 35 and is passed through line 36 into heater 37. In some cases, heater 37 may not be necessary. From line 38, said feed dispersion is passed through annular passage 39 of annulus-type burner 40. Simultaneously, a stream of free-oxygen containing gas from line 4 i.e. substantially pure oxygen from air separation unit 2 is passed through heater 11 and line 12 into central passage 41 of burner 40. Optionally, additional feed materials such as fuels, temperature moderator, or fluxing agents may be passed through burner 40 either in admixture with the aforesaid feed streams, or separately by way of an outer annulus passage in burner 40 (not shown). Optionally, the feedstreams may be interchanged. For example, the stream of free-oxygen containing gas may be passed through annular passage 39 and the other reactant stream may be passed through central passage 41.

Burner 40 is mounted in the upper axially aligned flanged inlet 42 of vertical free-flow synthesis gas generator 43. As previously described, gas generator 43 is a vertical steel pressure vessel. It has a refractory lining 44 and a unobstructed reaction zone 45. The effluent gas leaving the reaction zone passes into a gas cooling zone where it may be cooled by direct or indirect heat exchange with a coolant e.g. water. For example, the gas stream may be passed through passage 46 and into water contained in a quench zone such as quench tank 47. On the way, the gas stream may be sprayed with water from spray ring 48. Thus, water in the quench zone cools the effluent gas stream and scrubs out most of the solid particles i.e. ash and soot. Ash containing some fine particulate carbon particles settles to the bottom of quench tank 47 and may be removed periodically through axially aligned bottom flanged outlet 50, line 51, and a lock hopper system comprising valve 52, line 53, hopper 54, line 55, valve 56, and line 57. The larger particles of soot may form a carbon-water slurry which may be removed from quench zone 47 by way of flanged outlet 58 and line 59. The carbon-water slurry may be sent to a carbon recovery system (not shown) such as a settler where clean water is separated and recycled to orifice scrubber 62 by way of line 63. Clean make-up water may also be introduced through line 63. Optionally, the particulate carbon from the carbon recovery zone is dried, ground, and introduced into hopper 10.

A saturated process gas stream is removed through flanged exit port 65 near the top of quench zone 47 and passed through line 66 into orifice scrubber 62. Any remaining particulate carbon or entrained solids is scrubbed from the process gas stream in orifice scrubber 62 with water from line 63 and a carbon-water dispersion from line 67. The mixture of process gas and water leaving orifice scrubber 62 by way of line 68 is passed into gas-liquid separator 69. A first portion of carbon-water dispersion is removed from separator 69 through line 70 at the bottom. This stream may be combined with the carbon-water stream in line 59 and sent to the carbon recovery zone for separation as previously described. By means of pump 75 a second portion of the carbon-water stream may be pumped through lines 76 and 67 into orifice scrubber 62 as mentioned previously. Optionally another portion of carbon-water dispersion is pumped through line 77 and flanged inlet 78 into quench zone 47. Another portion of said carbon-water stream is preferably pumped through line 150, flanged inlet 151, and spray ring 48 into quench zone 47.

Clean process gas saturated with $H_2O$ is removed from the top of separator 69 through line 79 and is passed through heat exchanger 80. There it is heated to a temperature in the range of about 500° to 900°F by indirect heat exchange with a process gas stream leaving three stage catalytic shift converter 81 through lines 82 and 83 at a temperature in the range of about 600° to 1000°F. Gas cooler 84 situated between beds of conventional water-gas shift catalyst 85 and 86 and cooler 87 situated between conventional catalyst beds 86 and 88 control the exothermic reaction going on in the shift converter by heating boiler feed water flowing indirectly through gas coolers 84 and 87. At least a portion of the preheated process gas stream from heat exchanger 80 enters the first catalyst bed through lines 89 and 90 at the top of the shift converter 81 and flows serially down through the three catalyst beds and the two interbed coolers. Optionally, all or a portion of the process gas stream in line 89 may be by-passed through lines 91, valve 92 and line 93.

After being cooled in heat exchanger 80, as previously described, the process gas stream passes through line 94 and cooler 95 where it is cooled to a temperature below the dew point to condense substantially all of the $H_2O$ from the gas stream. The process gas stream is passed through line 96 into gas-liquid separator 97 where the condensed water is removed through line 98. Then the dry process gas stream is passed through line 99 into the bottom of acid gas scrubbing tower 100 in the gas purification and separation zone.

Included in the gas purification and separation zone may be the following equipment: tray-type acid gas scrubbing tower 100 where the process gas stream is scrubbed with at least one solvent absorbent e.g. methanol; related absorbent regenerators 105, 106, and 107; and various associated valves, pumps, coolers, heat exchangers, and reboilers. In the gas separation and purification zone the process gas stream may be split into the following gaseous stream: (a) a $CO_2$-rich stream substantially comprising $CO_2$ and a minor amount of $H_2S$ and COS impurity in line 110, (b) optionally a vent stream comprising $CO_2$ and less than 2 ppm of $H_2S$ in line 111, (c) a $H_2S$ rich gaseous stream substantially comprising the remainder of the $H_2S$ and substantially all of the COS produced in line 112, and $CO_2$; and (d) a product gas stream substantially comprising CO and $H_2$, when the free-oxygen containing gas is substantially pure oxygen, in line 113. When the free-oxygen containing gas is air, nitrogen is also in the product gas stream. Vent stream (*b*) is optional and may be eliminated.

The process gas stream entering through line 99 into bottom section 115 of acid-gas scrubbing tower 100 is scrubbed with liquid solvent absorbent that enters the tower through line 116 and is distributed by sparger 117, and also by overflow liquid solvent absorbent from plate 118. Liquid solvent absorbent containing most of the $H_2S$ and COS produced in the process is removed from the bottom of tower 100 through line 119 and cooled to a lower teperature and pressure by passage through expansion valve 120. The liquid stream is then passed through line 121, heat exchanger 122, and line 123 into the top plate 124 of solvent absorbent regenerator 107. As the liquid stream descends in column 107, it contacts a vaporized solvent absorbent stream which enters the column from line 125 and passes up the column through openings in bubble caps in the plurality of plates. Condensed liquid absorbent substantially free from $H_2S$, COS, and $CO_2$ is removed through line 126. This liquid stream is pumped by means of pump 127 through lines 128 and 129 into reboiler 130 where it is heated and vaporized. The vaporized absorbent stream is then introduced into column 107, as previously described. Regenerated liquid solvent absorbent is recycled to acid gas scrubbing tower 100 by way of line 128, line 131, heat exchanger 122, line 133, cooler 134 and line 116. An $H_2S$-rich gas stream containing gases from the group $H_2S$, COS, $CO_2$, and mixtures thereof leaves from line 112 at the top of regenerator 107 and may be sent to a Claus unit for the production of by-product solid sulfur.

The liquid solvent absorbent on intermediate plate 135 in column 100 contains $CO_2$ and some $H_2S$ and COS. To prevent build-up of these acid-gases in the system, this liquid solvent absorbent may be withdrawn through line 140 and regenerated in absorbent regenerator 105 in a similar manner as that described previously for the liquid solvent absorbent withdrawn from the bottom of tower 100 through line 119. The vent gas stream comprising $CO_2$, $H_2S$, and COS leaves absorbent regenerator 105 by way of line 111. The regenerated liquid solvent absorbent is recycled to tower 100 and enters through line 141 near the top.

The liquid solvent absorbent on plate 118 in column 100 is rich in $CO_2$ and contains a minor amount of $H_2S$. This liquid solvent absorbent is withdrawn through line 142 and regenerated in absorbent regenerator 106 in a similar manner as described previously for the liquid solvent absorbent withdrawn from the bottom of tower 100 through line 119. The regenerated liquid solvent absorbent is recycled to tower 100 and enters through line 143.

The $CO_2$-rich gas stream which leaves from line 110 at the top of absorbent regenerator 106, optionally in admixture with vent gas mixture from line 111, is supplied to compressor 23 for compression and recycle to the previously described feed system.

EXAMPLES

The following examples illustrate preferred embodiments of the process of this invention. While preferred modes of operation are illustrated, the examples should not be construed as limiting the scope of the invention. The process is continuous and the flow rates are specified on an hourly basis for all streams of materials.

A stream of 26,077 lbs. of dry Bituminous coal ground to a particle size so that 100% of the material passes through an ASTM E 11-70 Sieve Designation Standard 425 $\mu$m (Alternative No. 40) and at least 80% passes through an ASTM E 11-70 Sieve Designation 75 $\mu$m (Alternative No. 200) are introduced into a jet mixer and dispersed in a high pressure high velocity stream of 224,300 Standard Cubic Feet (SCF) of $CO_2$-rich gas. The $CO_2$-rich gas comprises in mole % $CO_2$ 95.8 and $H_2S$ 4.2. The temperature of the $CO_2$-rich gas stream is 70°F., the pressure is 725 psia.; and its velocity is 200 ft. per sec. The ultimate analysis of the coal in wt. % is C 72.75, H 5.24, N 1.64, S 3.35, and O 7.65. The ash content is 9.37 wt. %.

The dispersion of ground coal and $CO_2$-rich gas is heated to a temperature of 100°F. and by way of the annular passage of an annulus type burner is introduced into the reaction zone of a free-flow synthesis gas generator at a velocity of about 150 ft. per second at the burner tip. The burner is axially mounted in the upper flanged inlet of the gas generator. Simultaneously, a stream of 268,800 SCF of substantially pure oxygen (99.5 mole %) at a temperature of about 300°F. are passed through the center passage of said burner and leaves at the burner tip at a velocity of about 250 ft. per sec. The two streams impinge against each other in the reaction zone producing a uniform dispersion of oxygen, coal particles, and $CO_2$.

The gas generator is an unobstructed refractory lined pressure vessel and is free from catalyst other than that which might be naturally found in the coal. A typical gas generator having an upper reaction chamber, a lower quench chamber, and an axial passage through which the effluent gas stream from the reaction chamber may pass into water in the quench chamber is shown in the drawing.

In the reaction zone, the atomic ratio of $O_2$ in the substantially pure oxygen plus the combined organic oxygen in the coal to carbon in the coal is about 0.901; the weight ratio of $CO_2$ to coal is about 1.0; the temperature is about 2600°F; and the pressure is about 600 psia. The coal particles are reacted with oxygen by partial oxidation and with $CO_2$. The $CO_2$ serves as a carrier for the coal particles and as a temperature moderator by endothermic reaction with C.

The CO-rich effluent gas from the reaction zone is cooled and cleaned in a quench zone by passing it through a water spray and into quench water in the lower quench chamber of the gas generator. The water spray and scrubbing action that occurs as the effluent gas passes through the quench zone scrubs out most of the ash and particulate carbon soot. A 2 wt. % carbon-ash-water is drawn off from the bottom of the quench tank and sent to a separation zone. Clear water is separated and used for additional gas scrubbing. About 1500 lbs. of relatively low ash particulate carbon soot is recovered and dried by conventional means. Optionally, this dry soot and ash may be admixed with the dry fresh ground coal feed to the slurry tank; or it may be admixed with feed to the grinding system. About 1325 lbs. of ash having the following composition in wt. % is removed periodically from the bottom of the quench zone by way of a lock hopper system; ash 82, C 16.8, H 0.2, S 1.0.

The process gas stream leaving the quench zone is saturated with steam; and it is at a temperature of about 425°F. and a pressure of 600 p.s.i.a. About 1000 parts per million of soot is removed from this gas stream by scrubbing with water in a conventional orifice scrubber. By the aforesaid process about 1,000,000 SCF of dry CO-rich product gas stream is produced containing about 1,384,000 SCF of steam having the following composition in mole %: CO 67.46, $H_2$ 16.30, $CO_2$ 13.03, $CH_4$ 0.50, $H_2S$ 1.65, COS 0.34, A 0.14 and $N_2$ 0.58.

EXAMPLE II

This example describes the additional steps for producing a stream of $CO_2$-rich gas downstream from the process described in Example 1 and recycling said $CO_2$-rich gas stream back to said jet mixer to entrain and disperse said particles of ground coal as described in Example 1. 2,384,000 SCF of CO-rich saturated product gas stream from Example I are heated to a temperature of about 550°F. by indirect heat exchange with the effluent gas leaving a conventional water-gas shift converter filled with cobalt-molybdenum shift catalyst. The heated feed gas is passed sequentially through three beds of said water gas shift catalyst. Cooling means are provided after the first and second beds to control the temperature. Space velocities vary in the range of 8000 standard volumes of gas per volume of catalyst per hour (v/v/hr) in the first bed to 2000 v/v/hr in the last bed. The exit temperature of the process gas stream is about 600°F. By two heat exchange steps, the first with incoming feed gas in the shift converter and the second with cooling water, the process gas stream is reduced to a temperature below the dew point i.e. about 150°F. After water is removed, the process gas stream has the following composition: CO 4.48, $H_2$ 47.77, $CO_2$ 45.75, $CH_4$ 0.31, $H_2S$ 1.21, COS 0.02, A 0.10, and $N_2$ 0.36.

The process gas stream is then processed in an acid-gas scrubbing and fractionation tower with a methanol solvent and is separated into the following streams free from $H_2O$; (a) 844,000 SCFH of a product gas stream comprising in mole % $H_2$ 90.2, CO 8.4, $N_2$ + A 0.85, and $CH_4$ 0.58; (b) 224,000 SCFH of a $CO_2$-rich recycle gas stream comprising in mole % $CO_2$ 95.8 and $H_2S$ 4.2; (c) 497,900 SCFH of a $CO_2$-rich vent gas stream comprising in mole % $CO_2$ 99.77, $H_2$ 0.15 and CO 0.08; and (d) A $H_2S$-rich gas stream comprising in mole % $H_2S$ 35.14, $CO_2$ 63.51, and COS 1.35.

$CO_2$-rich recycle gas stream (stream) (*b*) is compressed to a pressure of 750 psig, and introduced into the "T" mixer to extrain and disperse said ground coal as previously described. About 5% of this $CO_2$-rich gas stream is employed to pressurize the pressurized running tank in the feed system. The $H_2S$-rich gas stream (*d*) is sent to a Claus unit for sulfur recovery, optionally with the remaining $CO_2$-rich vent gas stream (*c*).

The process of the invention has been described generally and by example with reference to $CO_2$-rich gas-solid carbonaceous fuel feedstocks of particular compositions for purposes of clarity and illustration only. It will be apparent to those skilled in the art from the foregoing that the various modifications of the process and the materials disclosed herein can be made without departure from the spirit of the invention.

We claim:

1. A continuous process for producing a gas stream principally comprising gases selected from the group consisting of CO, $H_2$, $CO_2$, $H_2O$, $CH_4$, $H_2S$, COS, $N_2$, A, and mixtures thereof comprising:

1. dispersing ground solid particles of carbonaceous fuel in a high pressure high velocity stream of $CO_2$-rich gas having a pressure in the range of about 50 to 5000 psig and a velocity in the range of about 5 to 500 ft. per sec.;
2. introducing the gas-solid fuel dispersion from (1) at a temperature in the range of about 80° to 1200°F, and simultaneously introducing a stream of free-oxygen containing gas selected from the group consisting of air, oxygen-enriched air (at least 22 mole % $O_2$), and substantially pure oxygen (at least 95 mole % $O_2$) at a temperature in the range of about 80 to 500°F into the reaction zone of a free-flow non-catalytic gas generator in the absence of supplemental $H_2O$ other than that normally found in said gas-solid fuel dispersion and free-oxygen containing gas;
3. reacting said carbonaceous fuel and free-oxygen by partial oxidation and reacting $CO_2$ in said reaction zone at an autogenous temperature in the range of about 1200 to 3000°F and a pressure in the range of about 30 to 4800 psig;
4. separating a $CO_2$-rich gas stream comprising in mole % $CO_2$ 80 to 100 and $H_2S$ 0 to 20 from the effluent gas stream from (3) in an acid-gas recovery zone; and
5. compressing said $CO_2$-rich gas stream and recycling said stream to (1) as said high pressure velocity stream of $CO_2$-rich gas.

2. The process of claim 1 wherein the weight ratio of $CO_2$ to carbonaceous fuel in step (1) is in the range of about 0.5 to 2.0.

3. The process of claim 1 wherein $H_2O$ at a temperature in the range of about 50° to 1000°F. and in an amount to provide a weight ratio $H_2O$ to carbonaceous fuel in the range of 0.01 to 0.15 is introduced into the reaction zone in step (2).

4. The process of claim 1 wherein the ratio of atoms of free oxygen in the free-oxygen containing gas plus organically combined oxygen in the carbonaceous fuel per atom of carbon in the carbonaceous fuel is in the range of about 0.70 to 1.6.

5. The process of claim 1 wherein said solid carbonaceous fuel is selected from the group consisting of coal, coke from coal, char from coal, petroleum coke, particulate carbon soot, oil shale, tar sands, asphalt, pitch, lignite, rubber, rubber tires, and mixtures thereof.

6. The process of claim 1 wherein said carbonaceous fuel has a particle size so that 100% of the material passes through an ASTM E 11-70 Sieve Designation Standard 425 $\mu$m (Alternative No. 40) and at least 80% passes through ASTM E 1170 Sieve Designation Standard 75 $\mu$m (Alternative No. 200).

7. A process for producing synthesis gas or fuel gas from solid carbonaceous fuel comprising: (1) dispersing dry ground solid particles of carbonaceous fuel in a dry high pressure velocity stream of $CO_2$-rich gas having a pressure in the range of about 50 to 5000 psig and a velocity in the range of about 5 to 500 ft. per sec. to produce a gas-solid dispersion having a weight ratio of $CO_2$ to solid carbonaceous fuel in the range of about 0.5 to 2.0; (2) preheating the dispersion from (1) to a temperature in the range of about 80°F to 1200°F; (3) reacting the dispersion from (2) with substantially dry free-oxygen containing gas selected from the group consisting of air, oxygen-enriched air (at least 22 mole % $O_2$), and substantially pure oxygen (at least 95 mole % $O_2$) in the reaction zone of a free-flow noncatalytic gas generator at an autogenous temperature in the range of about 1200° to 3000°F and a pressure in the range of 30 to 4800 psig, to produce an effluent gas stream comprising a mixture of gases from the group CO, $H_2$, $CO_2$, $H_2O$, $CH_4$, $H_2S$, COS, $N_2$, A, and mixtures thereof, and containing entrained solid particles; and wherein the ratio of atoms of oxygen in the free-oxygen containing gas plus the atoms of organically combined oxygen in the solid carbonaceous fuel to the atoms of carbon in the carbonaceous fuel is in the range of about 0.70 to 1.5 when said free-oxygen containing gas is substantially pure oxygen, and a value in the range of about 0.8 to 1.6 when said free-oxygen containing gas is air; (4) cooling and cleaning the effluent gas stream from (3) and separating said entrained solid particles to produce a clean process gas stream; (5) increasing the $H_2/CO$ ratio of the clean process gas stream from (4) by subjecting at least a portion of said process gas stream to water-gas shift reaction; (6) purifying and separating the process gas stream from (5) in a gas purification and separation zone into the following gaseous streams: (a) a dry $CO_2$-rich stream substantially comprising $CO_2$ and minor amounts of $H_2S$ and COS impurities, (b) optionally, a vent stream substantially comprising $CO_2$; (c) a dry $H_2S$-rich gaseous stream comprising gases from the group consisting of $H_2S$, COS, $CO_2$, and mixtures thereof; (d) a dry product gas stream comprising gases selected from the group consisting of CO, $H_2$, $CH_4$, A, $N_2$, and mixtures thereof; and (7) compressing at least a portion of said dry $CO_2$-rich gas stream from (a) and introducing said compressed gas stream into (1) as said high pressure high velocity $CO_2$-rich gas stream.

8. The process of claim 7 where in step (6) the dry $CO_2$-rich stream (a) comprising in mole % $CO_2$, 90 to 100, $H_2S$ 0 to 10, and COS 0 to 1 and a portion of the vent stream (b) comprising substantially pure $CO_2$ are removed from the gas purification and separation zone as a combined stream which is compressed and recycled as provided in step (7).

9. The process of claim 7 wherein said solid carbonaceous fuel is selected from the group consisting of coal, coke from coal, char from coal, petroleum coke, particulate carbon soot, oil shale, tar sands, asphalt, pitch, rubber, rubber tires, and mixtures thereof.

10. A process for producing synthesis gas or fuel gas from coal and carbon dioxide comprising:

1. grinding dry coal in a grinding zone to a particle size so that 100% of the material passes through an ASTM E 11-70 Sieve Designation Standard 425 $\mu$m (Alternative No. 140) and at least 80% passes through an ASTM E 11-70 Sieve Designation Standard 75 $\mu$m (Alternative No. 200);
2. transporting the ground coal from (1) by means of a carrier stream comprising compressed nitrogen gas from an air separation zone to a gas-solid separating zone where said nitrogen is separated from said ground coal;
3. introducing the ground coal from (2) into a pressurized feed zone having a positive feed controllable means for introducing the ground coal into a mixing zone where it is dispersed in a stream of $CO_2$-rich gas at a pressure in the range of about 50 to 5000 psig and a velocity in the range of about 5 to 500 ft. per sec. to produce a gas-solid dispersion having a weight ratio of $CO_2$ to ground coal in the range of about 0.5 to 2.0;
4. preheating the dispersion from (3) to a temperature in the range of about 80 to 1200°F.;
5. reacting the dispersion from (4) with substantially pure oxygen obtained from said air separation zone in the reaction zone of a free-flow noncatalytic gas generator at an autogenous temperature in the range of about 1200° to 3000°F. and a pressure in the range of about 30 to 4800 psig, to produce an effluent gas stream comprising a mixture of gases from the group CO, $H_2$, $CO_2$, $H_2O$, $CH_4$, $H_2S$, COS, $N_2$, A, and mixtures thereof, and containing entrained solid particles; and wherein the ratio of atoms of oxygen in the free-oxygen plus the atoms of organically combined oxygen in the ground coal to the atoms of carbon in the ground coal is in the range of about 0.70 to 1.6;
6. cooling and cleaning the effluent gas stream from (5) by quenching and scrubbing with water and separating said entrained solid particles to produce a clean process gas stream;
7. increasing the $H_2/CO$ ratio of the clean process gas stream from (6) by subjecting at least a portion of said process gas stream to water-gas shift reaction;
8. purifying and separating the process gas stream from (7) in a gas purification and separation zone into the following gaseous streams: (a) a dry $CO_2$-rich stream substantially comprising $CO_2$ and minor amounts of $H_2S$ and COS impurities, (b) a vent stream comprising $CO_2$ and less than about 1–5 parts per million (ppm) of $H_2S$; (c) a dry $H_2S$-rich gaseous stream substantially comprising the remainder of all of the $H_2S$ produced, substantially all of the COS produced, and $CO_2$; and (d) a dry product gas stream comprising gases selected from the group consisting of CO, $H_2$, $CH_4$, A, $N_2$, and mixtures thereof; and
9. compressing at least a portion of said dry $CO_2$-rich gas stream from (a) and introducing said compressed gas stream into (3) as said high pressure high velocity $CO_2$-rich gas stream.

11. The process of claim 10 wherein a portion of $CO_2$-rich stream selected from step 8 (a), step 8 (b), and mixtures thereof are used in place of nitrogen in step (2) as said carrier stream for transporting the ground coal.

12. The process of claim 7 provided with the step of adding supplemental $H_2O$ to the process gas stream from step (4) prior to subjecting said process gas stream to water-gas shift reaction in step (5).

* * * * *